US006742479B2

(12) United States Patent
Yanagisawa

(10) Patent No.: US 6,742,479 B2
(45) Date of Patent: Jun. 1, 2004

(54) FUEL SUPPLY SYSTEM FOR DIMETHYL ETHER ENGINE

(75) Inventor: Naoki Yanagisawa, Fujisawa (JP)

(73) Assignee: Isuzu Motors Limited, Tokyo (JP)

( * ) Notice: Subject to any disclaimer, the term of this patent is extended or adjusted under 35 U.S.C. 154(b) by 46 days.

(21) Appl. No.: 10/103,578

(22) Filed: Mar. 21, 2002

(65) Prior Publication Data

US 2002/0134323 A1 Sep. 26, 2002

(30) Foreign Application Priority Data

Mar. 22, 2001 (JP) ..... 2001-082894

(51) Int. Cl.[7] ..... F02M 37/20; F02D 1/00
(52) U.S. Cl. ..... 123/1 A
(58) Field of Search ..... 123/1 A, 3

(56) References Cited

U.S. PATENT DOCUMENTS

| | | | | |
|---|---|---|---|---|
| 4,413,594 A | * | 11/1983 | Hirota | 123/1 A |
| 4,444,158 A | * | 4/1984 | Yoon | 123/3 |
| 4,603,662 A | * | 8/1986 | Norton et al. | 123/1 A |
| 5,097,803 A | * | 3/1992 | Galvin | 123/3 |
| 5,632,786 A | * | 5/1997 | Basu et al. | 123/1 A |
| 6,076,487 A | * | 6/2000 | Wulff et al. | 123/1 A |

FOREIGN PATENT DOCUMENTS

| | | |
|---|---|---|
| DE | 198 48 831 A1 | 4/1999 |
| DE | 198 18 421 A1 | 10/1999 |
| FR | 2 779 775 | 12/1999 |
| GB | 2 316 981 A | 3/1998 |
| JP | 61-275586 | 12/1986 |
| JP | 09-317594 | 12/1997 |
| JP | 10-089185 | 4/1998 |
| JP | 11-022590 | 1/1999 |
| JP | 11-210557 | 3/1999 |
| JP | 11-107871 | 4/1999 |
| JP | 2000-110687 | 4/2000 |

* cited by examiner

*Primary Examiner*—Henry C. Yuen
*Assistant Examiner*—Jason Benton
(74) *Attorney, Agent, or Firm*—McCormick, Paulding & Huber LLP

(57) ABSTRACT

Damaging of a high-pressure fuel pump is prevented by driving the high-pressure fuel pump when interior lubrication of the high-pressure fuel pump is ensured. The fuel supply system (1) for a dimethyl ether engine, wherein dimethyl ether is supplied from a fuel tank (3) to a high-pressure fuel pump (5) while being raised to a saturated vapor pressure or above by means of a pressure feed pump (12) and is then raised to a pressure suitable for injecting into an engine by means of the high-pressure fuel pump (5) and supplied to a common rail (8) to which fuel injection devices (7) are connected, comprises: a dimethyl ether detecting device (16), disposed in a fuel pipe leading to said high-pressure fuel pump (5), for detecting the state of the dimethyl ether from the pressure feed pump (12); and an electronic control unit (17), connected to said dimethyl ether detecting device (16), for driving said high-pressure fuel pump (5) when the dimethyl ether inside the fuel pipe (6) leading to said high-pressure fuel pump (5) is in a liquid state.

5 Claims, 4 Drawing Sheets

FUEL SUPPLY SYSTEM FOR DIMETHYL ETHER ENGINE

This application is entitled to the benefit of and incorporates by reference essential subject matter disclosed in Japanese Patent Application No. 2001-082894 filed Mar. 22,2001.

BACKGROUND OF THE INVENTION

1. Field of the Invention

The present invention relates to a fuel supply system for a dimethyl ether engine, wherein dimethyl ether is supplied to a high-pressure fuel pump from a fuel tank whilst being raised to a saturated vapour pressure or above by means of a pressure feed pump, and is then raised by this high-pressure fuel pump to a pressure suitable for injection into a combustion chamber of an engine and supplied to a common rail to which a fuel injection device is connected.

2. Description of the Related Art

As shown in FIG. 4, in a conventional fuel supply system for a dimethyl ether engine, an electromotive pressure feed pump 52 for dimethyl ether fuel supply is provided in a fuel tank 51, in such a manner that dimethyl ether is supplied to a high-pressure fuel pump 54 by the pressure feed pump 52, by means of a fuel pipe 53. The high-pressure fuel pump 54 is connected to a common fuel 56, to which a fuel injection device 55 is connected, and the dimethyl ether is supplied to the common rail 56 whilst being raised to a pressure suitable for injection into an engine.

Here, the high-pressure fuel pump 54 has a piston structure comprising a plunger, or the like, in such a manner that the pressure of the dimethyl ether is raised by reciprocal motion of this plunger.

In the fuel supply system for a dimethyl ether engine described above, the lubrication of the plunger and plunger barrel inside the high-pressure fuel pump 54 is performed by the dimethyl ether fuel which contains an added lubricating agent.

Therefore, if the dimethyl ether is not supplied to the high-pressure fuel pump 54 in a liquid state, then a problem arises in that the lubrication of the plunger inside the pump is not performed smoothly and scraping and burning of the plunger, and the like, arises.

In other words, in cases where the fuel is diesel oil, for example, then even if the supply of fuel is interrupted for a short period of time, the peripheral region of the plunger does not become dry rapidly, whereas in the case of dimethyl ether, since the fuel is a gas at normal temperature and normal pressure, the peripheral region of the plunger does become dry rapidly and hence the aforementioned problems are liable to occur readily. Such problems are particularly frequent when starting up the engine.

SUMMARY OF THE INVENTION

The present invention was devised in order to resolve the aforementioned problems, an object thereof being to provide a dimethyl ether fuel supply system capable of driving a high-pressure fuel pump, whilst ensuring internal lubrication of the high-pressure fuel pump.

In order to achieve the aforementioned object, a first aspect of the present invention is a fuel supply system for a dimethyl ether engine, wherein dimethyl ether is supplied from a fuel tank to a high-pressure fuel pump whilst being raised to a saturated vapour pressure or above by means of a pressure feed pump and is then raised to a pressure suitable for injecting into an engine by means of the high-pressure fuel pump and supplied to a common rail to which fuel injection devices are connected, comprising: a dimethyl ether detecting device, disposed in a fuel pipe leading to the high-pressure fuel pump, for detecting the state of the dimethyl ether from the pressure feed pump; and an electronic control unit, connected to the dimethyl ether detecting device, for driving the high-pressure fuel pump when the dimethyl ether inside the fuel pipe leading to the high-pressure fuel pump is in a liquid state.

According to the composition described above, since the state of the dimethyl ether inside the fuel pipe leading to the high-pressure fuel pump is detected by a dimethyl ether detecting device, and the high-pressure fuel pump is driven by an electronic control unit in accordance with the state of the dimethyl ether, the high-pressure fuel pump is driven, causing compression of the dimethyl ether, only in cases where dimethyl ether in a liquid state is being supplied to the high-pressure fuel pump and hence lubrication thereof is ensured, thereby making it possible to prevent sticking, burning, or the like, of the internal mechanism of the high-pressure fuel pump.

A second aspect of the present invention is a fuel supply system for a dimethyl ether engine according to the first aspect of the present invention, wherein the dimethyl ether detecting device consists of a temperature sensor for detecting the temperature of the dimethyl ether inside the fuel pipe leading to the aforementioned high-pressure fuel pump and a pressure sensor for detecting the pressure of the dimethyl ether.

A third aspect of the present invention is the fuel supply system for a dimethyl ether engine according to either claim 1 or claim 2, wherein the electronic control unit is connected to an engine key section, as well as being connected to the pressure feed pump, and it activates the pressure feed pump when the engine key is set to an engine ON position, and activates the high-pressure fuel pump when the engine key is set to a starter ON position, only in cases where it is detected by the dimethyl ether detecting device that the dimethyl ether inside the fuel pipe leading to the high-pressure fuel pump is in a liquid state.

A fourth aspect of the present invention is a fuel supply system for a dimethyl ether engine, wherein dimethyl ether is supplied from a fuel tank to a high-pressure fuel pump whilst being raised to a saturated vapour pressure or above by means of a pressure feed pump and is then raised to a pressure suitable for injecting into an engine by means of the high-pressure fuel pump and supplied to a common rail to which fuel injection devices are connected, comprising: an electronic control unit for activating the pressure feed pump when an engine key is set to an engine ON position, and activating the high-pressure fuel pump when the engine key is set to a starter ON position, after a prescribed period of time from the activation of the pressure feed pump.

A fifth aspect of the present invention is the fuel supply system for a dimethyl ether engine according to the fourth aspect of the present invention, wherein the electronic control unit adjusts and changes the prescribed period of time in accordance with the internal temperature of the engine.

DESCRIPTION OF THE PREFERRED EMBODIMENTS

Embodiments of the present invention are described below with reference to the accompanying drawings.

Figure 1:
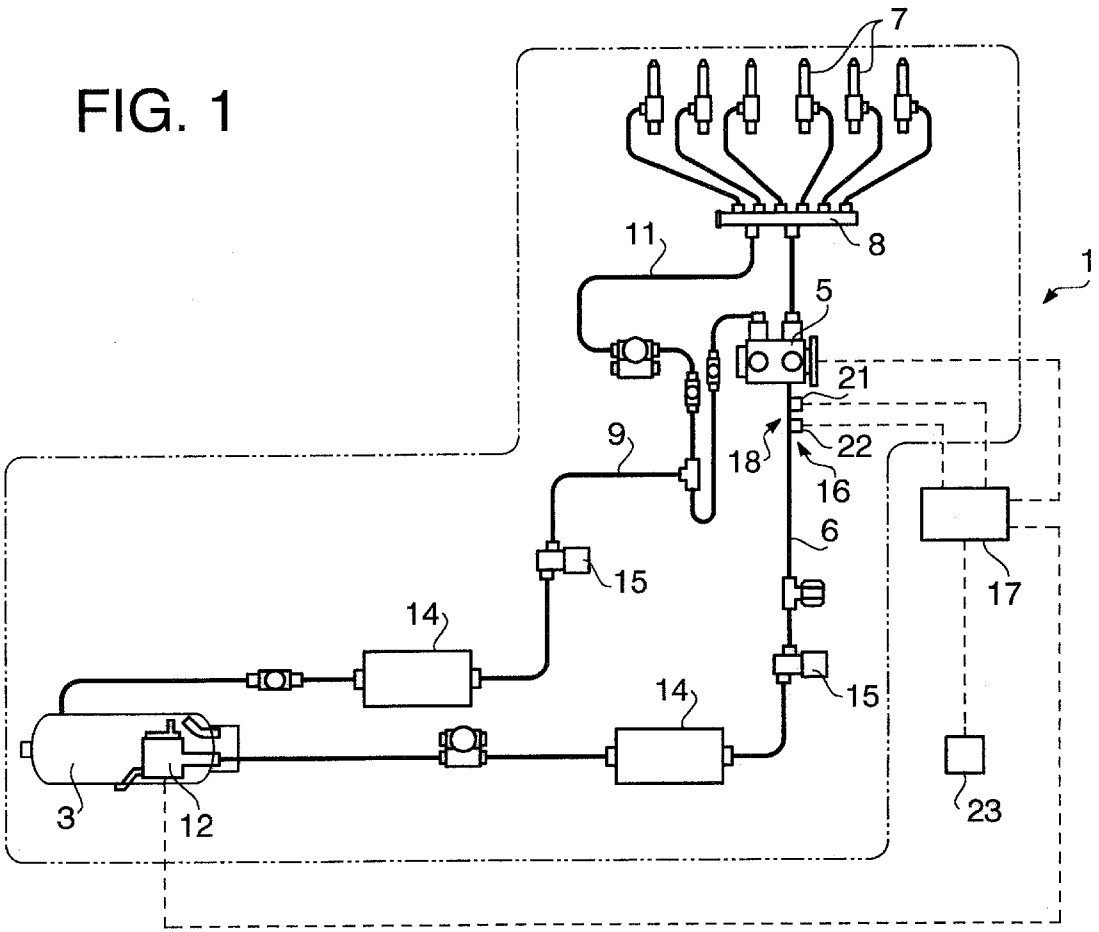
FIG. 1 is an approximate compositional diagram of a preferred embodiment of a fuel supply system for a dimethyl ether engine relating to the present invention.
Figure 2:
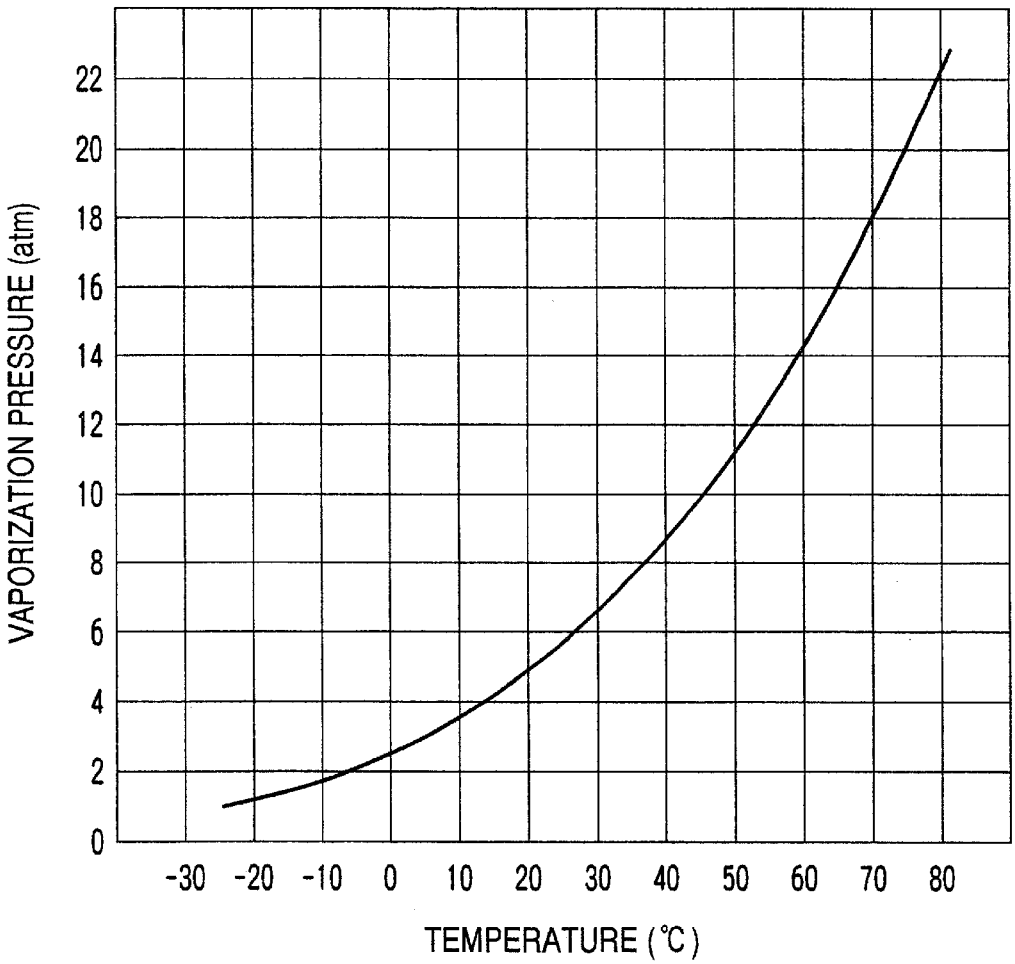
FIG. 2 is a graph of dimethyl ether vaporization pressure.

FIG. 1 is an approximate compositional diagram of a preferred embodiment of a fuel supply system for a dimethyl ether engine relating to the present invention, and FIG. 2 is a graph of the dimethyl ether vaporization pressure.

Firstly, the composition of the fuel supply system for a dimethyl ether engine relating to the present embodiment will be described.

As shown in FIG. 1, in the fuel supply system 1 according to this embodiment, a fuel tank 3 is provided on the chassis side (not illustrated). A fuel pipe 6 is connected to the fuel tank 3 in order to supply dimethyl ether (DME) fuel to a high-pressure fuel pump 5 provided on the engine side (not illustrated).

A common rail 8 is connected to the high-pressure fuel pump 5, this common rail 8 being connected to a plurality of fuel injection devices (injectors) 7 for injecting fuel into the combustion chambers of the engine (not illustrated).

A fuel return pipe 9 is connected to the high-pressure fuel pump 5 in order to return surplus fuel to the fuel tank 3. A fuel return pipe 11 is connected to an intermediate position of the fuel return pipe 9 in order to return the surplus fuel from the common rail 8 to the fuel 3.

A pressure feed pump 12 is provided inside the fuel tank 3 in order to raise the pressure of the dimethyl ether to a saturated vapour pressure, or above, and supply it to the high-pressure fuel pump 5.

In the diagram, 14 is a fuel cooler and 15 is a fuel cut-off valve.

A characteristic feature of the present invention is that it comprises a dimethyl ether detecting device 16, provided at the inlet section 18 of the fuel pipe 6 to the high-pressure fuel pump 5, for sensing the state of the dimethyl ether supplied by the pressure feed pump 12, and an electronic control unit (ECU) 17, connected to the dimethyl ether detecting device 16, for driving the high-pressure fuel pump 5 when the dimethyl ether inside the fuel pipe 6 to the high-pressure fuel pump 5 is in a liquid state.

The dimethyl ether detecting device 16 is constituted by a temperature sensor 21 and a pressure sensor 22 which are provided in the fuel pipe 6 at the inlet section 18 of the high-pressure fuel pump 5. The temperature sensor 21 and pressure sensor 22 serve to measure the temperature and pressure of the dimethyl ether inside the fuel pipe 6.

The relationship between temperature and vaporization pressure from the dimethyl ether vaporization pressure graph shown in FIG. 2 is input to the electronic control unit 17, in such a manner that the state of the dimethyl ether (namely, whether or not it is liquid) is detected from the temperature and pressure of the dimethyl ether at the inlet section 18 of the high-pressure fuel pump 5.

The electronic control unit 17 is electrically connected to the high-pressure fuel pump 5 and the pressure feed pump 12, in such a manner that it sends drive signals to the high-pressure fuel pump 5 and pressure pump 12.

Moreover, the electronic control unit 17 is connected to an engine key section 23, and is set in such a manner that when the engine key is in the engine ON position, it activates the pressure feed pump 12, and when the engine key is in the starter ON position, it activates the high-pressure fuel pump 5 only in cases where the dimethyl ether detecting device 16 senses that the dimethyl ether at the inlet section 18 of the high-pressure fuel pump 5 is in a liquid state.

Next, the action of the fuel supply system 1 of the dimethyl ether engine according to the foregoing composition will be described.

According to this composition, when starting the engine, if the engine key is set to the engine ON position, then the electronic control unit 17 starts up the pressure feed pump 12, and the dimethyl ether in the fuel pipe 6 is pressurized.

If the engine key is set to the starter ON position, then the dimethyl ether detecting device 16 detects the temperature and pressure of the dimethyl ether at the inlet section 18 of the high-pressure fuel pump 5. The detected pressure and temperature are input to the electronic control unit 17 and compared with a dimethyl ether vaporization pressure graph previously input to the electronic control unit 17 (to detect whether the pressure at the inlet section 18 is higher or lower than the vaporization pressure at that temperature), and thereby it is sensed whether the dimethyl ether is in a liquid or gaseous state.

If it is sensed that the dimethyl ether is gaseous, then the engine starter including the high-pressure fuel pump 5 is not started up, and the operations of driving the pressure feed pump 12 and sensing the state of the dimethyl ether are continued.

If it is sensed that the dimethyl ether is liquid, then the starter including the high-pressure fuel pump 5 is started. In this case, the dimethyl ether in a liquid state flows into the high-pressure fuel pump 5, the peripheral region of the plunger is lubricated thereby, and hence sticking, burning, and the like can be prevented.

In other words, according to the present invention, the high-pressure fuel pump 5 is only driven, thereby compressing the dimethyl ether, when dimethyl ether in a liquid state is supplied to the high-pressure fuel pump 5 and the lubrication thereof is ensured, and hence damage of the high-pressure fuel pump 5 can be prevented.

Moreover, in the fuel supply system for a dimethyl ether engine relating to the present invention, if the dimethyl ether detecting device 16 constantly detects the state of the dimethyl ether at the inlet section 18 of the high-pressure fuel pump 5, then in cases where the dimethyl ether supplied to the high-pressure fuel pump 5 is not in liquid form, not only at engine start up, but also due to a fault or other reason of some kind, then this is detected and the high-pressure fuel pump 5 can be halted, thereby preventing damage thereof.

Figure 3:
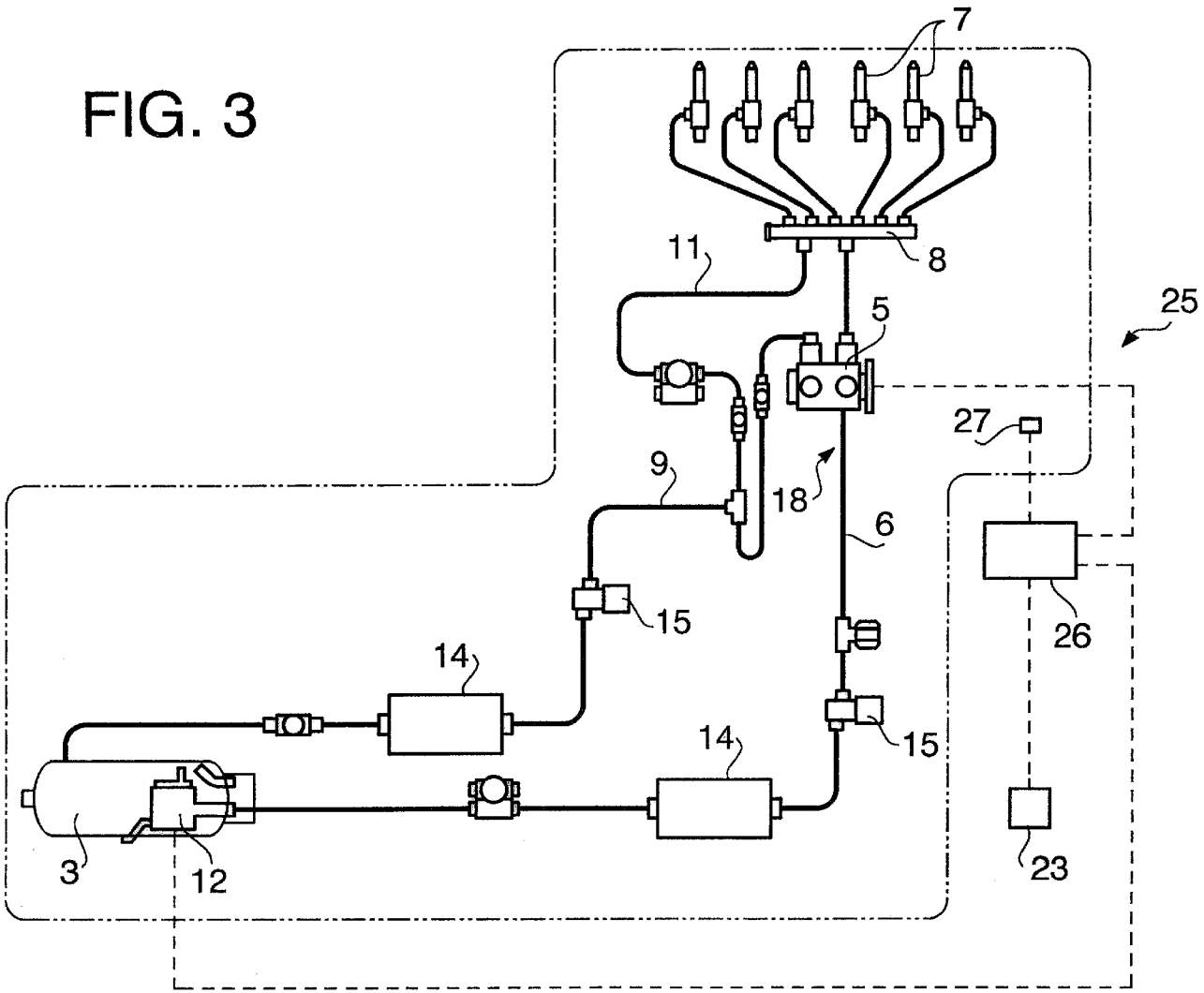
FIG. 3 is an approximate compositional diagram of a further preferred embodiment of a fuel supply system for a dimethyl ether engine relating to the present invention.
Figure 4:
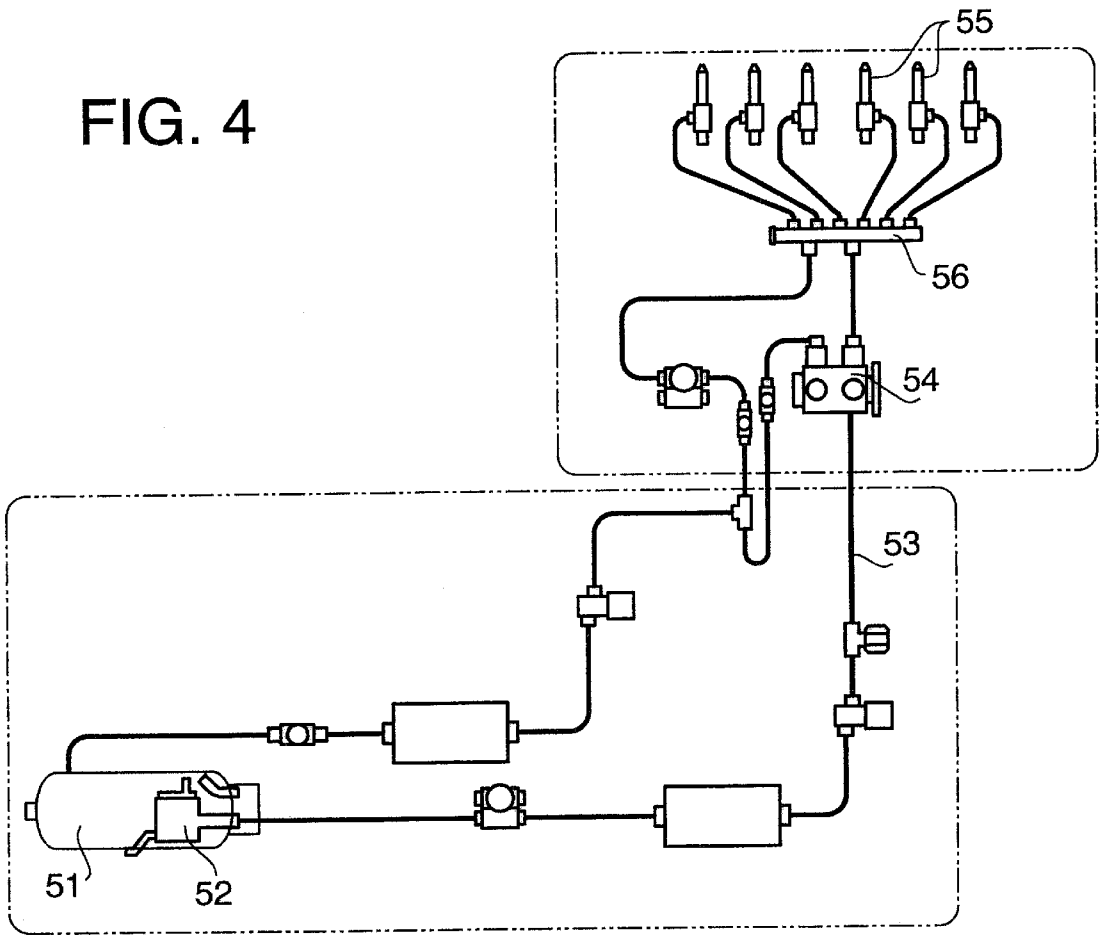
FIG. 4 is an approximate compositional diagram of a conventional fuel supply system for a dimethyl ether engine.

FIG. 3 is an approximate compositional diagram showing a further preferred embodiment of the fuel supply system for a dimethyl ether engine relating to the present invention.

The fuel supply system 25 in FIG. 3 eliminates the dimethyl ether detecting device 16 of the fuel supply system 1 shown in FIG. 1, and the activation of the high-pressure fuel pump 5 is performed after a prescribed period of time has elapsed from the activation of the pressure feed pump 12.

In other words, the electronic control unit 26 provided in the fuel supply system 25 comprises a timer function, and the pressure feed pump 12 is activated when the engine key is in the engine ON position, and the high-pressure fuel pump 5 is activated when the engine key is in the starter ON position, after a previously determined prescribed period of time has elapsed from the activation of the pressure feed pump 12.

Moreover, a temperature sensor 27 for detecting the internal temperature of the engine chamber is connected to the electronic control unit 26, in such a manner that the aforementioned period of time is adjusted according to the internal temperature of the engine chamber as detected by the temperature sensor.

The remaining composition is the same that the fuel supply system 1 in FIG. 1 and is similarly labelled, further description thereof being omitted here.

According to the aforementioned composition, it is possible to achieve a similar action to the fuel supply system 1, without requiring the dimethyl ether detecting device 16 in FIG. 1, and therefore device simplification, weight reduction and cost reduction are also achieved.

However, in this case, although reliability is slightly inferior to that of the fuel supply system 1 shown in FIG. 1, this problem can be resolved if sufficient surplus is allowed in the time period set. Moreover, since the aforementioned prescribed time period is adjusted according to the internal temperature of the engine chamber, then it is possible to minimize time loss.

According to the present invention as described above, since the high-pressure fuel pump is driven to cause compression of the dimethyl ether, only in states where the internal lubrication of the high-pressure fuel pump is ensured, an excellent advantage is obtained in that damaging of the high-pressure fuel pump can be prevented.

What is claimed is:

1. A fuel supply system for a dimethyl ether engine, wherein dimethyl ether is supplied from a fuel tank to a high-pressure fuel pump whilst being raised to a saturated vapour pressure or above by means of a pressure feed pump and is then raised to a pressure suitable for injecting into an engine by means of the high-pressure fuel pump and supplied to a common rail to which fuel injection devices are connected, comprising:

a dimethyl ether detecting device, disposed in a fuel pipe leading to said high-pressure fuel pump, for detecting the state of the dimethyl ether from the pressure feed pump; and an electronic control unit, connected to said dimethyl ether detecting device, for driving said high-pressure fuel pump when the dimethyl ether inside the fuel pipe leading to said high-pressure fuel pump is in a liquid state.

2. The fuel supply system for a dimethyl ether engine according to claim 1, wherein said dimethyl ether detecting device comprises a temperature sensor for detecting the temperature of the dimethyl ether inside the fuel pipe leading to said high-pressure fuel pump and a pressure sensor for detecting the pressure of said dimethyl ether.

3. The fuel supply system for a dimethyl ether engine according to claim 1, wherein said electronic control unit is connected to an engine key section, as well as being connected to said pressure feed pump, and it activates said pressure feed pump when the engine key is set to an engine ON position, and activates said high-pressure fuel pump when the engine key is set to a starter ON position, only in cases where it is detected by said dimethyl ether detecting device that the dimethyl ether inside the fuel pipe leading to said high-pressure fuel pump is in a liquid state.

4. A fuel supply system for a dimethyl ether engine, wherein dimethyl ether is supplied from a fuel tank to a high-pressure fuel pump whilst being raised to a saturated vapour pressure or above by means of a pressure feed pump and is then raised to a pressure suitable for injecting into an engine by means of the high-pressure fuel pump and supplied to a common rail to which fuel injection devices are connected, comprising an electronic control unit for activating said pressure feed pump when an engine key is set to an engine ON position, and activating said high-pressure fuel pump when the engine key is set to a starter ON position, after a prescribed period of time from the activation of said pressure feed pump.

5. The fuel supply system for a dimethyl ether engine according to claim 4, wherein said electronic control unit adjusts and changes said prescribed period of time in accordance with the internal temperature of the engine.

* * * * *